US007628556B2

(12) United States Patent
Naruse

(10) Patent No.: US 7,628,556 B2
(45) Date of Patent: Dec. 8, 2009

(54) INKJET CARRIAGE UNIT, INKJET RECORDING APPARATUS, AND IMAGE FORMING APPARATUS

(75) Inventor: Shinichiro Naruse, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 389 days.

(21) Appl. No.: 11/324,716

(22) Filed: Jan. 3, 2006

(65) Prior Publication Data

US 2006/0146106 A1 Jul. 6, 2006

(30) Foreign Application Priority Data

Jan. 5, 2005 (JP) ..... 2005-000422

(51) Int. Cl.
*B41J 20/16* (2006.01)

(52) U.S. Cl. ..... 400/279

(58) Field of Classification Search ..... 347/37; 400/319, 320, 321, 322, 59, 279, 352, 692, 400/705.1

See application file for complete search history.

(56) References Cited

U.S. PATENT DOCUMENTS

| | | | | |
|---|---|---|---|---|
| 5,075,609 | A * | 12/1991 | Ito et al. | 318/696 |
| 5,563,591 | A * | 10/1996 | Jacobs et al. | 341/13 |
| 5,588,757 | A * | 12/1996 | Unosawa et al. | 400/279 |
| 6,601,944 | B1 * | 8/2003 | Kawazoe | 347/37 |
| 6,722,757 | B2 * | 4/2004 | Saito | 347/29 |
| 6,789,869 | B2 * | 9/2004 | Takeishi | 347/16 |
| 6,929,356 | B2 * | 8/2005 | Hirano et al. | 347/85 |
| 7,083,251 | B2 * | 8/2006 | Kang et al. | 347/19 |

FOREIGN PATENT DOCUMENTS

| | | |
|---|---|---|
| JP | 2958131 | 7/1999 |
| JP | 2003-72048 | 3/2003 |
| JP | 2004-122685 | 4/2004 |

* cited by examiner

*Primary Examiner*—Anh T. N. Vo
(74) *Attorney, Agent, or Firm*—Cooper & Dunham, LLP

(57) ABSTRACT

An inkjet carriage unit is disclosed that includes a main body, a sensor holding part detachably attached to the main body, and an encoder sensor attached to the sensor holding part.

14 Claims, 7 Drawing Sheets

INKJET CARRIAGE UNIT, INKJET RECORDING APPARATUS, AND IMAGE FORMING APPARATUS

BACKGROUND

1. Technical Field

This disclosure relates generally to an inkjet carriage unit and an image forming apparatus, such as an inkjet recording apparatus, using the same.

2. Description of the Related Art

Image forming apparatuses such as inkjet recording apparatuses have a scanning part that causes a carriage having recording heads mounted thereon to scan paper in a predetermined scanning direction while guiding the carriage with a guide rod. The recording heads are driven based on image data during scanning by the carriage so that an image is formed. In general, these inkjet recording apparatuses include a linear scale bearing marks for detecting the position of printing heads, and a read sensor to read the marks while moving along the linear scale. The linear scale is shaped like an elongated film extending in the scanning direction of the carriage. Its marks are provided at very narrow intervals (for example, 0.084 mm in the case of 300 dpi) (see, for example, Japanese Patent No. 2958131).

In image forming apparatuses such as inkjet recording apparatuses as described above, various modifications such as making many component parts and members replaceable are made so as to make apparatus service life much longer, for example, tenfold. In this respect, there is a need to remove and replace a carriage or replace a light emission part and a light reception part forming an encoder sensor. This is because longer apparatus service life may cause contamination of the encoder sensor, specifically, its light emission part and light reception part, with ink mist, thus causing a problem in that position detection cannot be performed with accuracy.

In order to perform such replacement, first, it is necessary to remove the carriage from a guide rod. In this case, the conventional structure also requires the linear scale to be removed. However, since the marks of the linear scale are arranged at very fine intervals, an operator is prevented from touching the marks with her/his hand. This is because the sebum of the hand adheres to the marks of the linear scale through touching them so as to prevent the marks from being read. Therefore, according to the conventional structure, it is almost impossible to actually remove and replace the carriage.

SUMMARY

In an aspect of this disclosure, an inkjet carriage unit is provided in which it is possible to replace a carriage or an encoder sensor without removing a linear scale so that an operator can work without the fear of touching the linear scale.

In another aspect, an inkjet recording apparatus and an image forming apparatus are provided which employ such an inkjet carriage unit.

In another aspect, an inkjet carriage unit is provided which includes a main body, a sensor holding part detachably attached to the main body, and an encoder sensor attached to the sensor holding part.

In another aspect of this disclosure, a carriage and an encoder sensor can be replaced without removing a linear scale. As a result, an operator is less likely to touch the linear scale with her/his hand.

In another aspect, an inkjet recording apparatus including an inkjet carriage unit is provided according to one embodiment of the present invention.

In another aspect, an image forming apparatus including an inkjet carriage unit is provided according to one embodiment of the present invention.

BRIEF DESCRIPTION OF THE DRAWINGS

Other aspects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

First Embodiment

Figure 1:
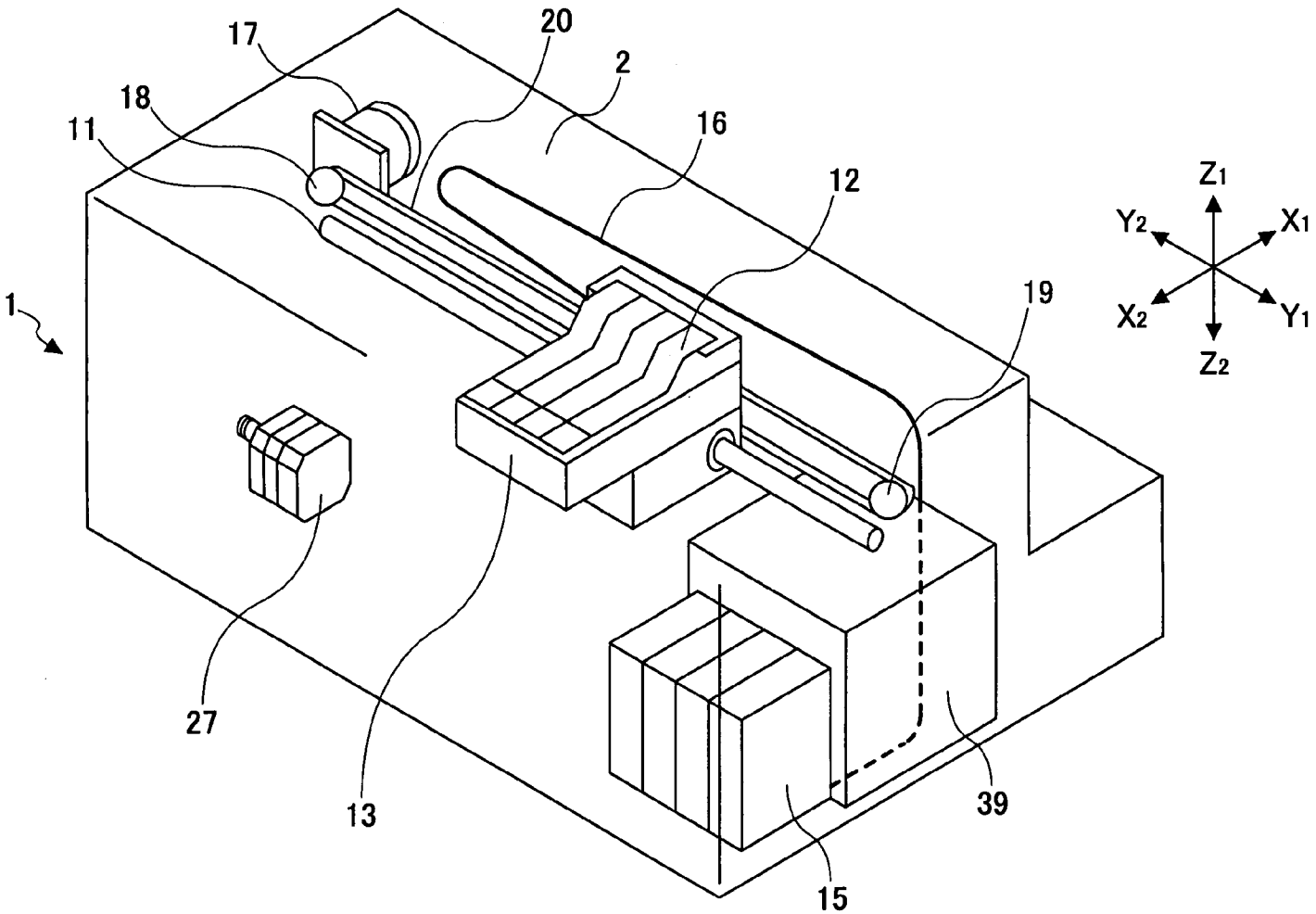
FIG. 1 is a perspective view of an inkjet recording apparatus according to a first embodiment of the present invention.
Figure 2:
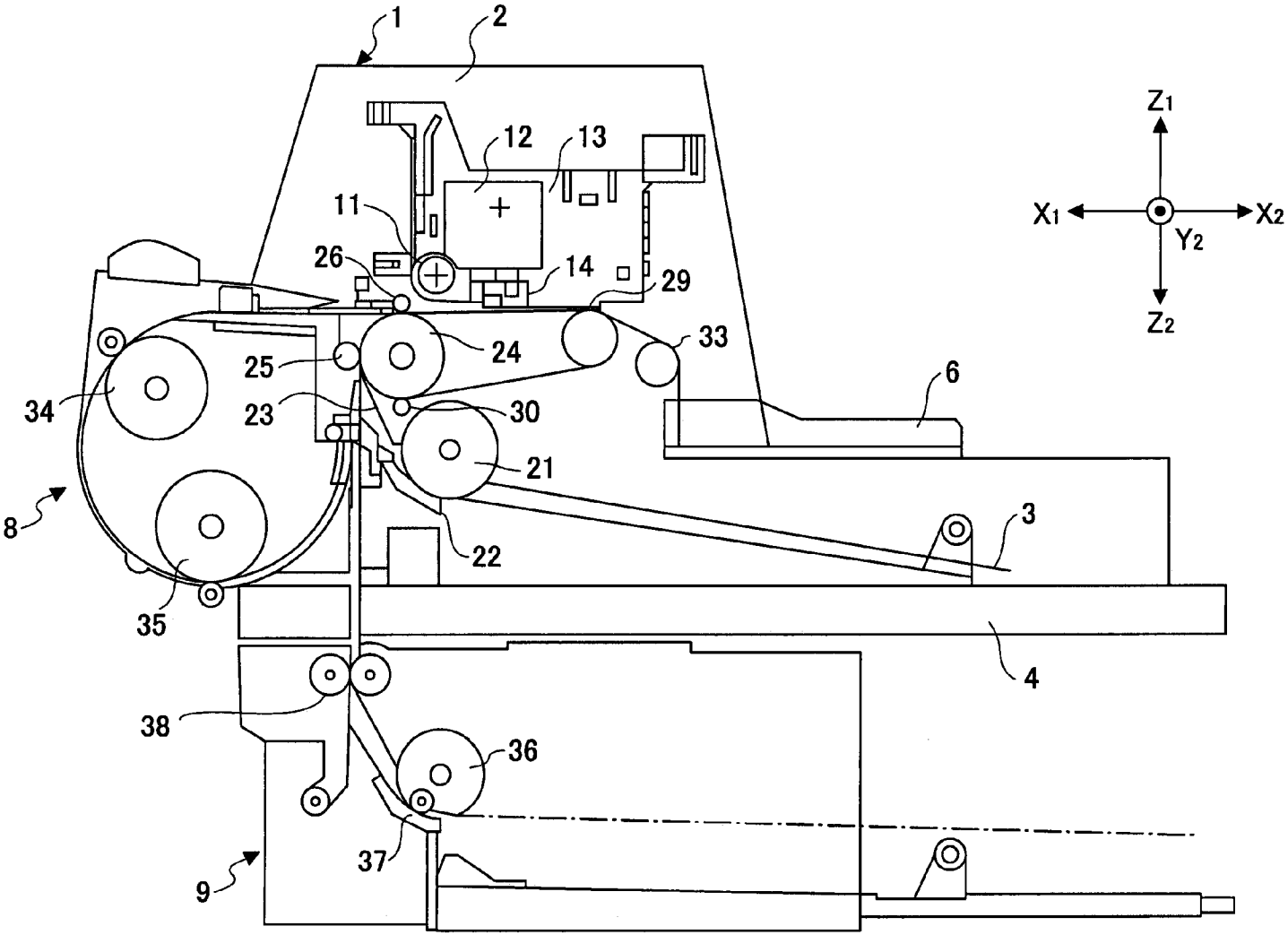
FIG. 2 is a side view of a mechanism part of the inkjet recording apparatus according to the first embodiment of the present invention.

FIG. 1 is a perspective view of an inkjet recording apparatus, which is an example of the image forming apparatus to which the present invention is applied, according to a first embodiment of the present invention. FIG. 2 is a side view of a mechanism part of the inkjet recording apparatus of FIG. 1. The inkjet recording apparatus has a print mechanism part 2 housed in a main body 1 of the inkjet recording apparatus. The print mechanism part 2 includes a carriage 13, a recording head 14, and sub tanks (ink cartridges) 12. The carriage 13 is movable in the main scanning directions ($Y_1$ and $Y_2$ directions in FIGS. 1 and 2). The recording head 14 includes multiple inkjet heads mounted on the carriage 13. The sub tanks 12 supply ink to the recording head 14. A paper feed cassette 4 (or a paper feed tray) capable of carrying multiple sheets of paper 3 is attached detachably and reattachably to a lower part of the main body 1 from its front side ($X_1$ side). The paper 3 is fed from the paper feed cassette 4 into the print mechanism part 2, where a required image is recorded on the paper 3. Thereafter, the paper 3 is output onto a paper output tray 6 attached to the rear side ($X_2$ side) of the main body 1.

The print mechanism part 2 holds the carriage 13 with a main guide rod 11 so that the carriage 13 is slidable in the main scanning directions. The main guide rod 11 is provided between $Y_1$-side and $Y_2$-side side plates (not graphically illustrated). The recording head 14 including inkjet heads ejecting ink droplets of respective colors of yellow (Y), cyan (C), magenta (M), and black (Bk) is attached to this carriage 13 so that the ink droplets are ejected downward (in the $Z_2$ direction). The sub tanks 12 for supplying color inks to the recording head 14 are attached to an upper part of the carriage 13.

Each sub tank 12 is connected through an ink supply tube 16 to a corresponding one of replaceably attached ink tanks 15, so that a corresponding one of the color inks is supplied therefrom to the sub tank 12. The main guide rod 11 passes through an $X_1$-side part of the carriage 13 (a upstream-side part of the carriage 13 in the paper conveyance direction) so that the carriage 13 is slidable on the main guide rod 11. In order to cause the carriage 13 to move and scan in the main scanning directions, a timing belt 20 is engaged with a drive pulley 18 rotated by a main scanning motor 17 and a driven pulley 19 so as to be stretched therebetween, and the timing belt 20 is fixed to the carriage 13.

On the other hand, in order to convey the paper 3 set in the paper feed cassette 4 to the lower ($Z_2$) side of the recording head 14, a paper feed roller 21 and a friction pad 22 to separate and feed the paper 3 from the paper feed cassette 4, a guide member 23 to guide the paper 3, a conveyance roller 24 to convey the fed paper 3 in a reversed position (upside down), a conveyance roller 25 to be pressed against the cylindrical surface of the conveyance roller 24, and an edge roller 26 to determine an angle at which the paper 3 is fed out from the conveyance roller 24 are provided. The conveyance roller 24 is rotated by a sub scanning motor 27 through a gear train.

An electrostatic conveyor belt 29 to guide the paper 3 fed from the conveyance roller 24 below the recording head 14 is provided in correspondence to the range of movement of the carriage 13 in the main scanning directions. The electrostatic conveyor belt 29 is charged by a charger 30 so as to attract the conveyed paper 3 so that the paper 3 adheres to the electrostatic conveyor belt 29, thereby keeping the surface of the paper 3 and the surface of the recording head 14 in parallel with each other. A paper output roller 33 to send out the paper 3 onto the paper output tray 6 is provided on the downstream side of the electrostatic conveyor belt 29 in the paper conveyance direction.

If necessary, a paper reversing unit 8 and a paper feed unit 9 may be attached to the main body 1 as shown in FIG. 2. The paper reversing unit 8 includes a first conveyance roller 34 and a second conveyance roller 35. After the recording head 14 performs printing on one side of the paper 3, the conveyance roller 24 is rotated in the reverse direction so as to draw the paper 3 into the main body 1. The paper 3 is reversed (turned upside down) by way of the first conveyance roller 34 and the second conveyance roller 35 inside the paper reversing unit 8 so as to be fed onto the conveyance roller 24. Then, the paper 3 is conveyed to the lower side of the recording head 14 with the other side thereof facing toward the recording head 14, and printing is performed on the other side of the paper 3. The paper feed unit 9 includes a paper feed roller 36, a friction pad 37, and carrying-out rollers 38. The paper feed unit 9 is capable of receiving a large amount of paper equal in size to or different in size from the paper 3 contained in the paper feed cassette 4. As a result, it is possible to select and use a suitable one of the paper 3 from the paper feed cassette 4 and the paper from the paper feed unit 9.

Figure 3:
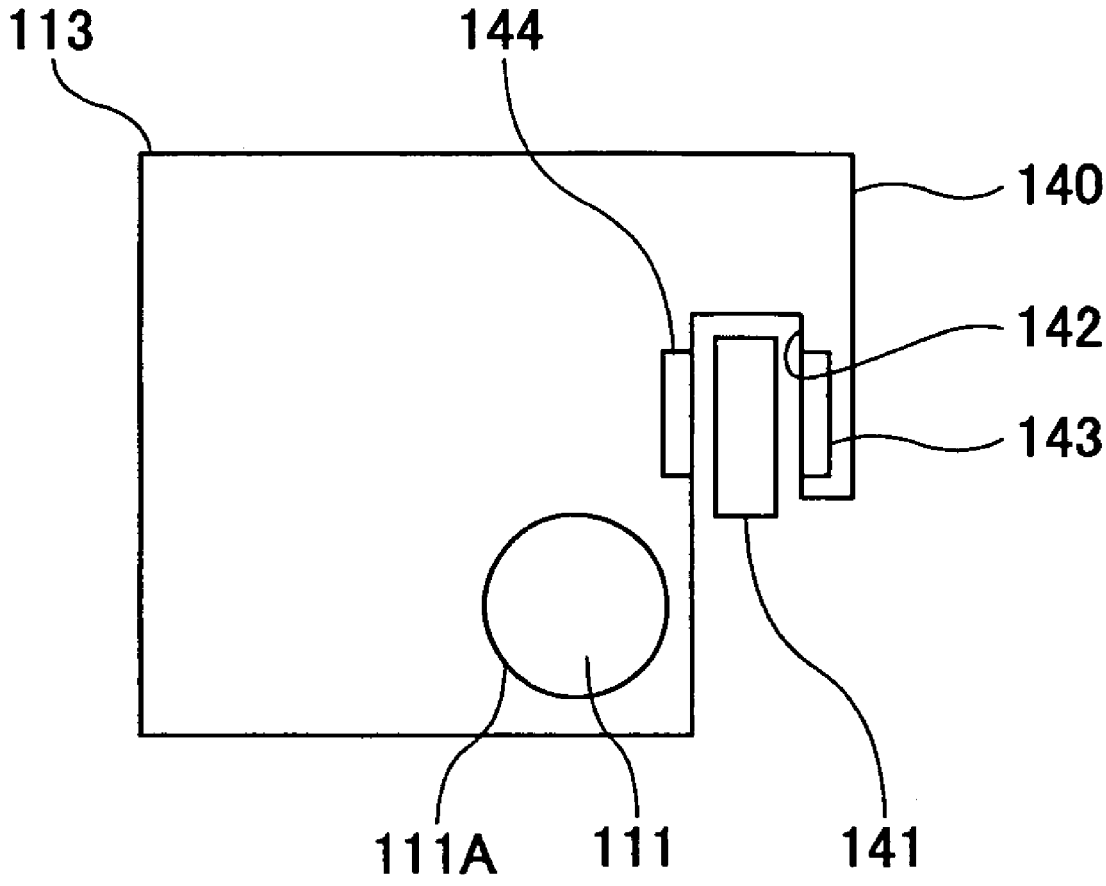
FIG. 3 is a conceptual cross-sectional view of a conventional carriage.

FIG. 3 is a conceptual cross-sectional view of a conventionally used carriage 113. Referring to FIG. 3, the carriage 113 includes an encoder sensor 140 at a position obliquely upward from an insertion part 111A including a hole through which a main guide rod 111 passes. The encoder sensor 140 includes a groove part 142 through which a linear scale 141 passes. A light emission part 143 is provided on one side and a light reception part 144 is provided on the other side on the interior surface of the groove part 142 so as to read the marks of the linear scale 141 as described above, thereby detecting the position of the carriage 113. The positions of the light emission part 143 and the light reception part 144 shown in FIG. 3 may be interchanged.

Figure 4:
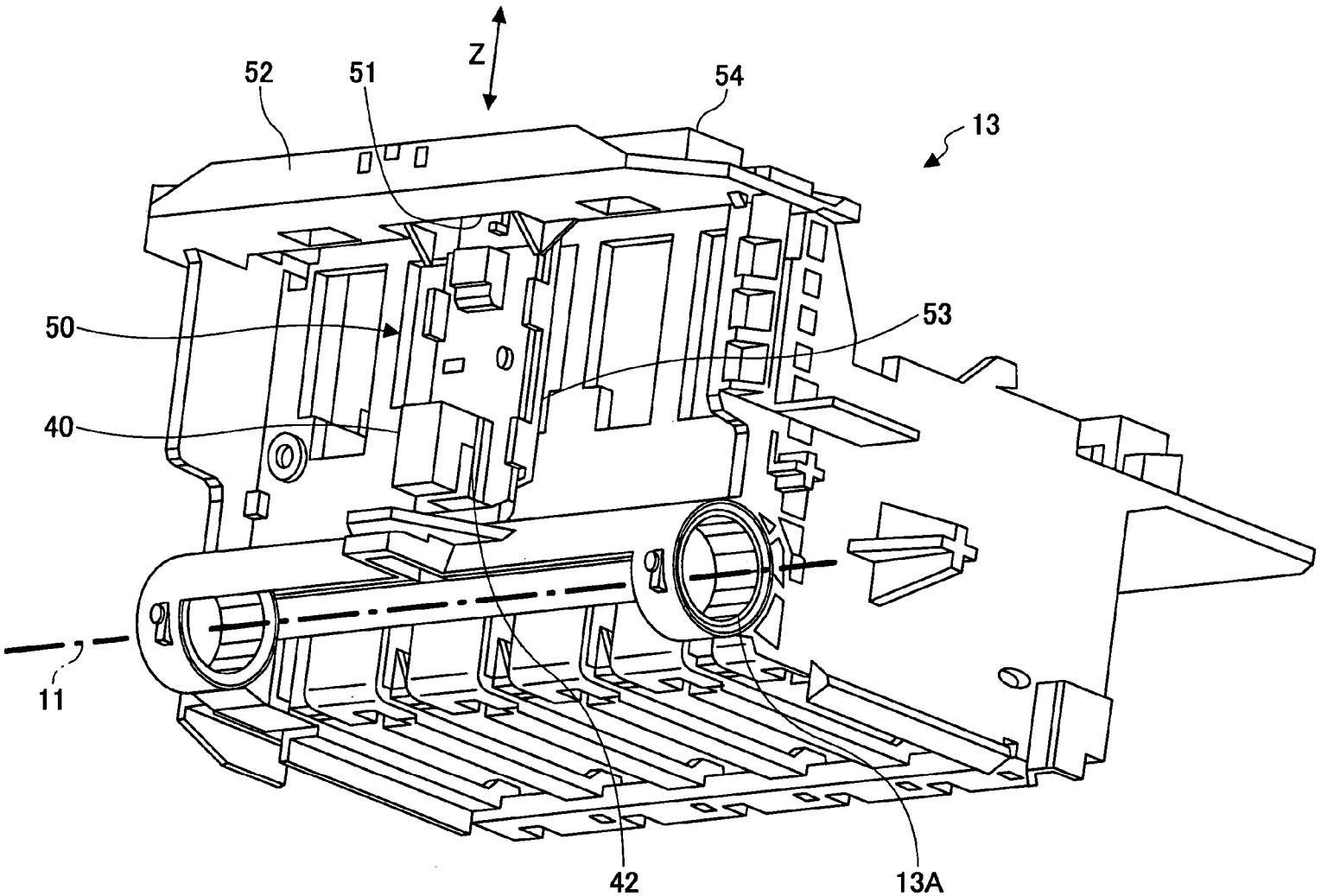
FIG. 4 is a perspective view of a carriage according to the first embodiment of the present invention.
Figure 5:
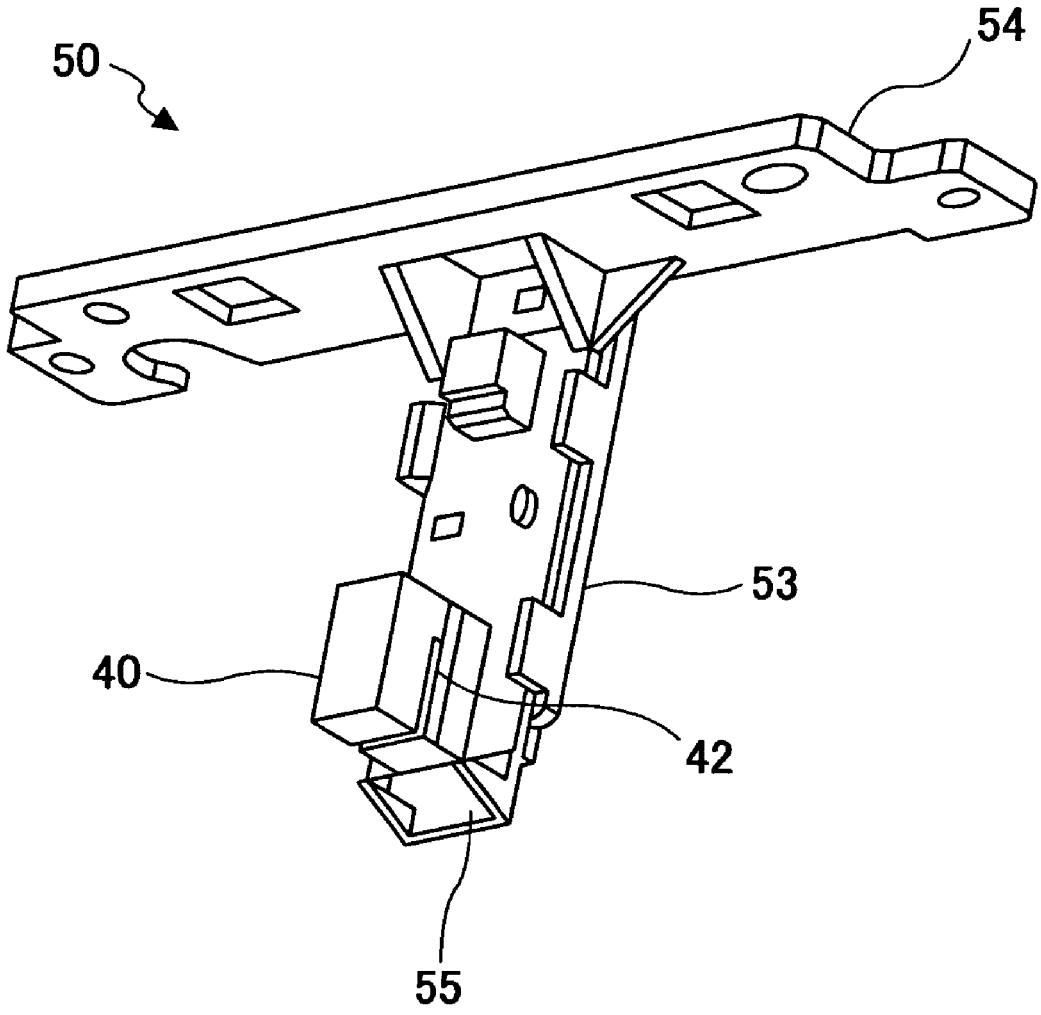
FIG. 5 is a perspective view of a sensor holding member according to the first embodiment of the present invention.
Figure 6:
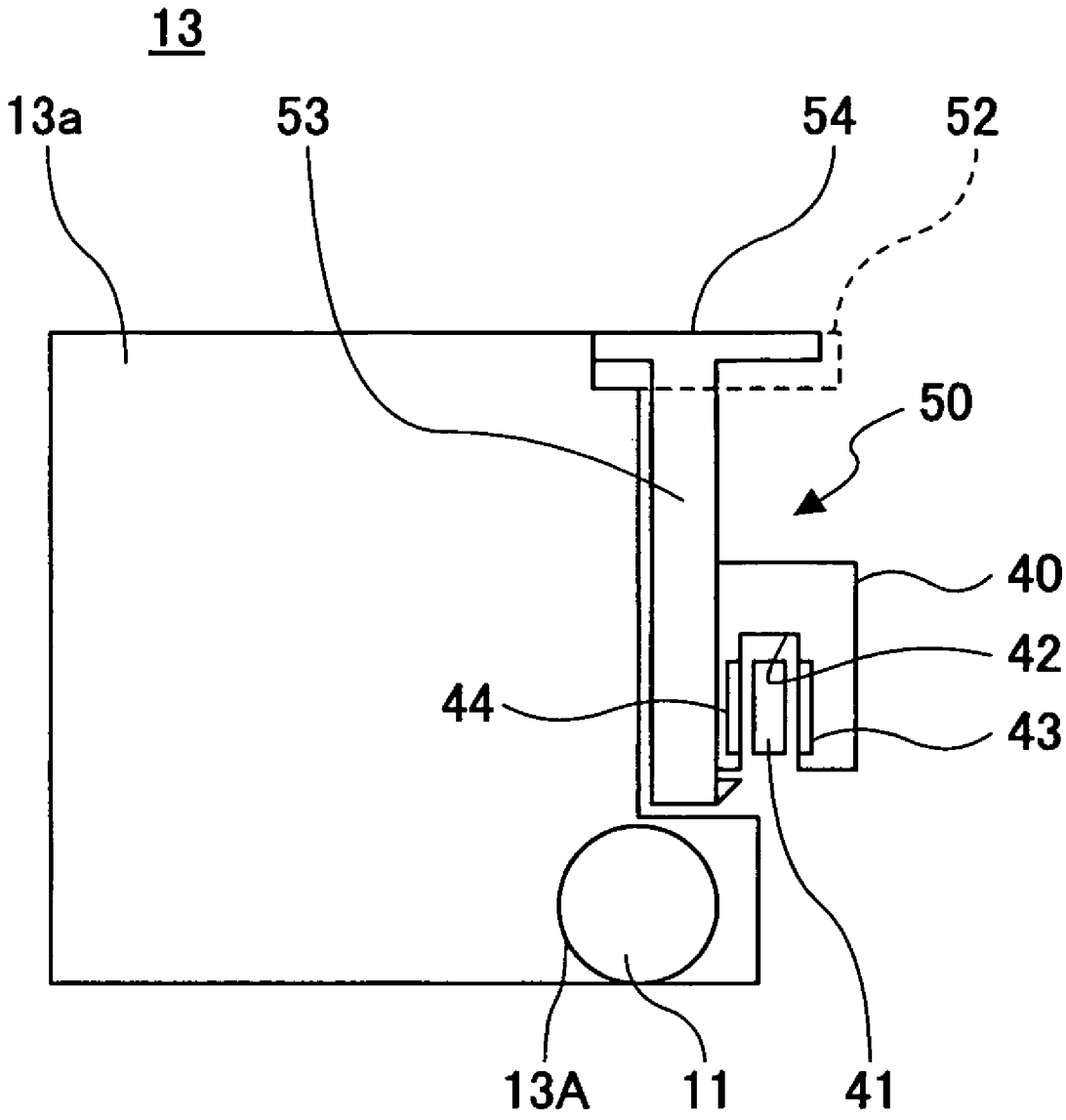
FIG. 6 is a cross-sectional view of the carriage according to the first embodiment of the present invention.

FIG. 4 is a perspective view of the carriage 13 according to this embodiment. FIG. 5 is a perspective view of a sensor holding member 50 according to this embodiment. FIG. 6 is a conceptual cross-sectional view of the carriage 13 according to this embodiment.

As graphically illustrated, the carriage 13 includes the sensor holding member 50 for holding an encoder sensor 40. The sensor holding member 50 is provided at a position obliquely upward from an insertion part 13A through which the main guide rod 11 passes. That is, the sensor holding member 50 is provided at a position above and offset at an angle from the insertion part 13A. The sensor holding member 50 is attachable and detachable (removable) in the vertical directions (or along the Z-axis indicated by the double-headed arrow in FIG. 4). Specifically, an attachment part 52 including an opening 51 for inserting and extracting the sensor holding member 50 is formed in an upper part of the carriage 13. The sensor holding member 50 is attached to a main body 13*a* of the carriage 13 through the opening 51 from its upper side. The sensor holding member 50 in the attached state is pulled upward and extracted easily through the opening 51.

The sensor holding member 50 includes a holding part 53 that can pass through the opening 51 and a base plate part 54 that does not pass through the opening 51, and is formed into a T letter shape. The encoder sensor 40 is held by the holding part 53, being attached to the vicinity of a lower end of the holding part 53. It is desirable that the encoder sensor 40 be detachable from and reattachable to the holding part 53. The encoder sensor 40 includes a groove part 42 through which a linear scale 41 passes. A light emission part 43 is provided on one side and a light reception part 44 is provided on the other side on the interior surface of the groove part 42 so as to read the marks of the linear scale 41 as described above, thereby detecting the position of the carriage 13. The positions of the light emission part 43 and the light reception part 44 shown in FIG. 6 may be interchanged.

A guide part 55 is provided on the lower end of the sensor holding member 50 so as to protrude therefrom in such a manner as to receive the encoder sensor 40. The lower end surface of the guide part 55 is formed like a slope that is lower on the side of the main body 13*a* of the carriage 13 and higher on the side of the encoder sensor 40. As a result, even if the slope (lower end surface) of the guide part 55 comes into contact with the linear scale 41 in attaching the sensor holding member 50, the slope serves as a slide guide and does not become a load on the linear scale 41. The linear scale 41 may have a tape-like shape.

That is, according to this embodiment, removal and replacement of the carriage 13 and removal and replacement of the encoder sensor 40 are performed by first releasing fixation of the base plate part 54 of the sensor holding member 50 to the attachment part 52 of the carriage 13, then pulling the entire body of the sensor holding member 50 upward, and extracting the holding member 53 through the opening 51. If a configuration does not allow the encoder sensor 40 to pass through the opening 51, the encoder sensor 40 may be detached from the holding part 53 with the sensor holding member 50 being pulled halfway up. As a result, it is possible to extract the main guide rod 11 and remove the carriage 13 without the possibility of touching the linear scale 41. Even if the main guide rod 11 or the carriage 13 comes into contact with the linear scale 41 during this operation, there is hardly any problem. Further, the carriage 13 and the encoder sensor 40 may be attached in the opposite procedure to the one described above.

Second Embodiment

Figure 7:
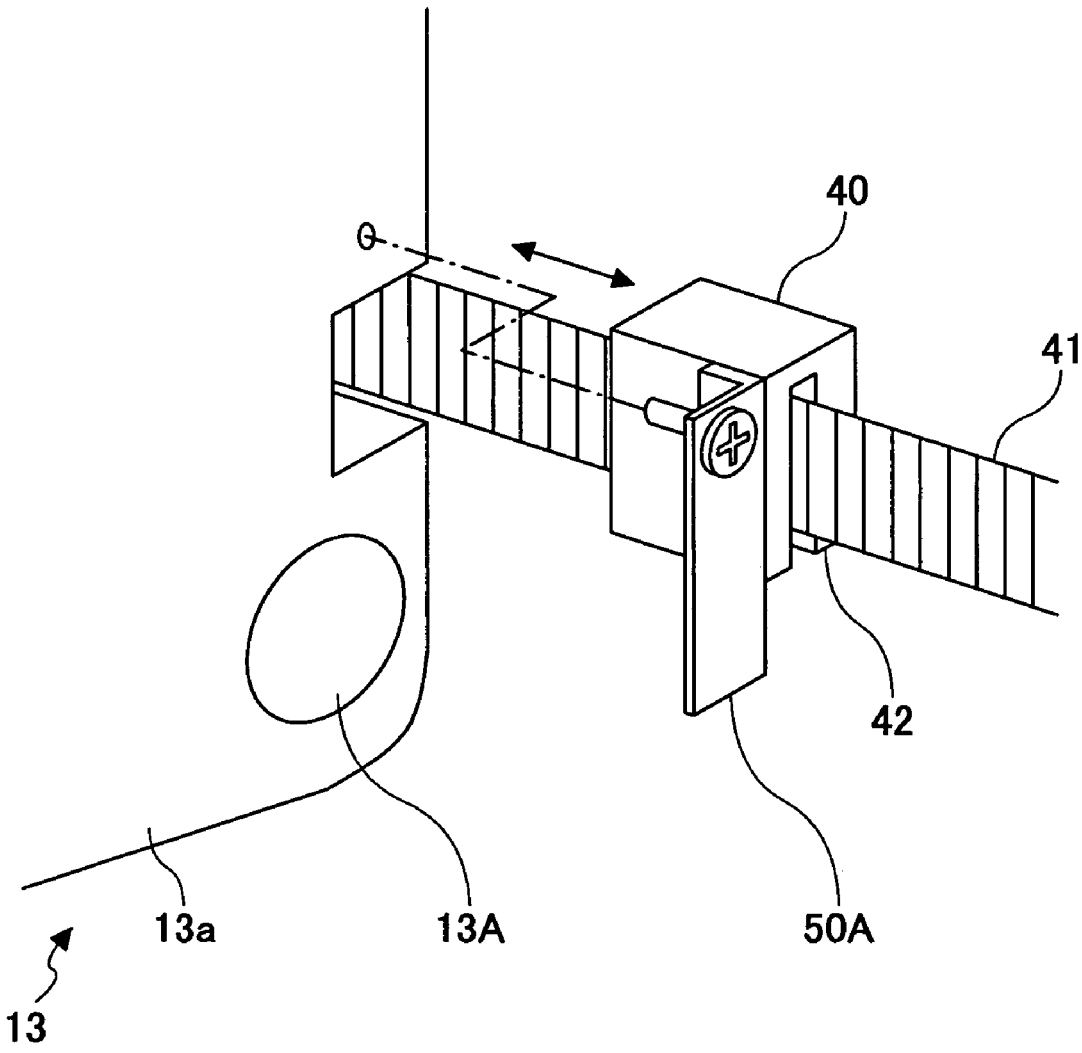
FIG. 7 is a perspective view of the carriage according to a second embodiment of the present invention.

Further, in the first embodiment, the sensor holding member 50 is detachable from and reattachable to the main body 13*a* of the carriage 13 in the vertical directions. Alternatively, as shown in FIG. 7, a sensor holding member 50A may be formed like a flange so as to be fixable to a side of the carriage 13 with a screw, and be attached and detached laterally. Further, if the positional relationship with the main guide rod 11 allows in terms of structure, the sensor holding member 50 may be attached and detached from the lower ($Z_2$) side or the rear ($X_2$) side of the carriage 13. Any structure may be employed as long as the structure allows the sensor holding member 50 to be attached and detached with the carriage 13 being attached to the main guide rod 11.

Thus, according to one aspect of the present invention, a carriage and an encoder sensor can be replaced without removing a linear scale. As a result, an operator is less likely to touch the linear scale with her/his hand.

The present invention is not limited to the specifically disclosed embodiments, and variations and modifications may be made without departing from the scope of the present invention.

The present application is based on Japanese Priority Patent Application No. 2005-000422, filed on Jan. 5, 2005, the entire contents of which are hereby incorporated by reference.

What is claimed is:

1. An image forming apparatus comprising:

a guide rod extending in a main scanning direction;

a linear scale provided above said guide rod;

a carriage unit held by said guide rod and configured to slide in the main scanning direction along the guide rod, said carriage unit comprising:

a main body including an attachment part formed in an upper part of the main body and having an opening therein;

a sensor holding member detachably attached to the main body and including a holding part and a base plate part attached to the holding part; and an encoder sensor attached to the sensor holding part, wherein the encoder sensor includes a groove part having a space through which a linear scale passes, and the groove part is open in a downward direction so that when the sensor holding member is moved in an upward direction, the linear scale no longer occupies the space inside of the groove part, wherein the opening is configured for inserting and extracting the sensor holding member therethrough, the holding part is configured to pass through the opening, and the base plate part is configured such that when the holding part is inserted through the opening, the base plate part remains above the attachment part of the main body and is prevented from passing through the opening, wherein when said sensor holding member is attached to the main body of the carriage unit, the sensor holding member is positioned above the guide rod with the linear encoder being in said space of said groove part.

2. The image forming apparatus as claimed in claim 1, wherein the encoder sensor is detachably and reattachably attached to the sensor holding member.

3. The image forming apparatus as claimed in claim 1, wherein the encoder sensor comprises a guide through which the linear scale is to pass.

4. The image forming apparatus as claimed in claim 3, wherein the guide comprises a groove-like part configured to open in a downward direction.

5. The image forming apparatus as claimed in claim 4, wherein a light emission part and a light reception part are provided opposite each other on an interior surface of the groove-like part of the guide.

6. The image forming apparatus as claimed in claim 1, wherein the sensor holding member is attachable to the main body from a lateral side thereof.

7. The image forming apparatus as claimed in claim 1, wherein the sensor holding member is attachable to the main body from a lower side thereof.

8. The image forming apparatus as claimed in claim 1, wherein the sensor holding member is attachable to the main body from a rear side thereof.

9. The image forming apparatus as claimed in claim 1, wherein the sensor holding member includes a guide through which the linear scale passes.

10. The image forming apparatus as claimed in claim 1, wherein the linear scale has a tape-like shape.

11. The image forming apparatus as claimed in claim 1, wherein:

the encoder sensor has an opening facing toward a first direction in which the sensor holding member is attached to the main body and extending along a second direction in which the linear scale is to pass through the encoder sensor, and the sensor holding member is configured to be detachable from the main body in a third direction opposite to the first direction while holding the encoder sensor.

12. The image forming apparatus as claimed in claim 1, wherein said carriage unit is configured such that the sensor holding member is extracted simultaneously from the carriage unit and the linear scale, by pulling the sensor holding member in an upward direction to pull the holding part through the opening.

13. An image forming apparatus comprising:

a guide rod extending in a main scanning direction;

a linear scale provided above said guide rod;

a carriage unit held by said guide rod and configured to slide in the main scanning direction along the guide rod, said carriage unit comprising:

a main body including an attachment part formed in an upper part of the main body and having an opening therein;

a sensor holding member detachably attached to the main body and including a holding part and a base plate part attached to the holding part; and an encoder sensor attached to the sensor holding part, wherein the opening is formed in the upper part of the main body so that the sensor holding member is attached to the main body through the opening, the holding part and the base plate part of the sensor holding member form a T letter shape, and the encoder sensor is provided in a vicinity of a lower end of the holding part, and wherein the encoder sensor includes a groove part having a space through which a linear scale passes, and the groove part is open in a downward direction so that when the sensor holding member is moved in an upward direction, the linear scale no longer occupies the space inside of the groove part, wherein the opening is configured for inserting and extracting the sensor holding member therethrough, the holding part is configured to pass through the opening, and the base plate part is configured such that when the holding part is inserted through the opening, the base plate part remains above the attachment part of the main body and is prevented from passing through the opening, wherein when said sensor holding member is attached to the main body of the carriage unit, the sensor holding member is positioned above the guide rod with the linear encoder being in said space of said groove part.

14. The image forming apparatus as claimed in claim 13, wherein the lower end of the holding part of the sensor holding member is formed like a slope.

* * * * *